US008087415B2

(12) United States Patent
Pires et al.

(10) Patent No.: US 8,087,415 B2
(45) Date of Patent: Jan. 3, 2012

(54) ADJUSTABLE APPLICATOR ASSEMBLY

(75) Inventors: Leo Clifford Pires, Basking Ridge, NJ (US); Roger Hwang, Maple (CA); Rahul Bose, New Deli (IN); Koushik Kohli, Uttar Pradesh (IN); Santosh Mohapatra, New Delhi (IN); Iti Seth, New Delhi (IN); Manisha Kohli, New Delhi (IN); Vaishali Srivastava, New Delhi (IN)

(73) Assignee: Zen Design Solutions Limited, Wanchai (HK)

( * ) Notice: Subject to any disclaimer, the term of this patent is extended or adjusted under 35 U.S.C. 154(b) by 333 days.

(21) Appl. No.: 12/391,803

(22) Filed: Feb. 24, 2009

(65) Prior Publication Data

US 2010/0212682 A1 Aug. 26, 2010

(51) Int. Cl.

| | |
|---|---|
| ***A45D 40/26*** | (2006.01) |
| ***A46B 11/00*** | (2006.01) |
| ***A46B 7/06*** | (2006.01) |
| ***A47L 13/00*** | (2006.01) |
| ***A47L 23/04*** | (2006.01) |
| ***E04F 21/16*** | (2006.01) |

(52) U.S. Cl. ..... 132/218; 401/127; 401/129; 15/106; 15/201

(58) Field of Classification Search ..... 132/218, 132/216, 217, 212, 120, 317, 318, 320, 237, 132/262, 136, 151; 401/121, 126, 182, 122, 401/282, 286, 127, 129, 268, 118, 119, 125, 401/123; 15/207.2, 159.1, 106, 201, 203; 206/581, 823

See application file for complete search history.

(56) References Cited

U.S. PATENT DOCUMENTS

| | | | | | |
|---|---|---|---|---|---|
| 726,716 | A | * | 4/1903 | Maher | 15/201 |
| 2,435,394 | A | * | 2/1948 | Hawley | 15/201 |
| 3,529,899 | A | | 9/1970 | Gruska | |
| 3,921,650 | A | * | 11/1975 | Montgomery | 132/218 |
| 4,475,563 | A | * | 10/1984 | Martin | 132/136 |
| 4,600,328 | A | * | 7/1986 | Clements | 401/129 |
| 4,662,385 | A | * | 5/1987 | Schefer | 132/218 |
| 4,972,858 | A | * | 11/1990 | Beck et al. | 132/218 |
| 5,052,839 | A | * | 10/1991 | Pettengill | 401/126 |
| 5,086,793 | A | | 2/1992 | Kingsford | |
| 5,121,763 | A | * | 6/1992 | Kingsford | 132/317 |

(Continued)

FOREIGN PATENT DOCUMENTS

WO WO 95/17837 A1 7/1995

(Continued)

OTHER PUBLICATIONS

PCT international search report and written opinion of PCT/US2010/024223 dated Apr. 16, 2010.

*Primary Examiner* — Todd Manahan
*Assistant Examiner* — Vanitha Elgart
(74) *Attorney, Agent, or Firm* — Patterson & Sheridan, LLP

(57) ABSTRACT

An applicator assembly and in particular, relates to an adjustable applicator capable of being adjusted to retain variable quantities of a product is provided. Also disclosed is a container comprising an applicator assembly for storing and application of consumer products such as cosmetic, hair care or dental products. The applicator assembly is configured to comprise at least two applicator heads, wherein the applicator heads are arranged to be movable relative to each other thereby resulting in change in density of the bristles of the applicator assembly.

23 Claims, 8 Drawing Sheets

U.S. PATENT DOCUMENTS

| | | | | |
|---|---|---|---|---|
| 5,137,038 | A * | 8/1992 | Kingsford | 132/218 |
| 5,611,361 | A * | 3/1997 | Leone | 132/218 |
| 5,620,270 | A * | 4/1997 | Gueret | 401/126 |
| 5,722,436 | A * | 3/1998 | Vandromme et al. | 132/218 |
| 5,937,871 | A | 8/1999 | Clay | |
| 6,145,514 | A * | 11/2000 | Clay | 132/218 |
| 6,306,717 | B1 * | 10/2001 | Claverie | 438/380 |
| RE37,605 | E * | 3/2002 | Clay | 132/218 |
| 6,408,857 | B1 * | 6/2002 | Neuner | 132/218 |
| 6,450,178 | B1 * | 9/2002 | Clay | 132/218 |
| 7,069,936 | B2 * | 7/2006 | Gueret | 132/218 |
| 2006/0051155 | A1 * | 3/2006 | Delage | 401/127 |
| 2008/0041406 | A1 * | 2/2008 | Le | 132/211 |
| 2008/0083421 | A1 * | 4/2008 | Malvar et al. | 132/218 |
| 2008/0245382 | A1 * | 10/2008 | Marciniak-Davoult et al. | 132/200 |
| 2008/0302379 | A1 | 12/2008 | Chan | |
| 2009/0114239 | A1 * | 5/2009 | Chen | 132/218 |
| 2009/0276973 | A1 * | 11/2009 | Bouix et al. | 15/206 |
| 2010/0175708 | A1 * | 7/2010 | Kim | 132/218 |
| 2010/0294298 | A1 * | 11/2010 | Kim | 132/218 |
| 2010/0300475 | A1 * | 12/2010 | Gueret | 132/218 |
| 2011/0030718 | A1 * | 2/2011 | Gueret | 132/218 |
| 2011/0048448 | A1 * | 3/2011 | Legassie | 132/218 |

FOREIGN PATENT DOCUMENTS

| | | |
|---|---|---|
| WO | WO 96/31143 | 10/1996 |

* cited by examiner

ADJUSTABLE APPLICATOR ASSEMBLY

BACKGROUND

1. Field of the Invention

Embodiments of the present invention generally relate to an adjustable applicator assembly and in particular, relates to an adjustable applicator capable of being adjusted to retain variable quantities of a product. The invention also relates to a container comprising said adjustable applicator assembly for storing and application of consumer products such as cosmetic, hair care or dental products. The adjustable applicator assembly of the present applicator heads are arranged to be movable relative to each other thereby resulting in change in density of the bristles of the applicator assembly.

2. Description of the Related Art

Numerous types of applicators and systems have been designed and developed in the recent years. Conventionally, applicators include a shaft, at one end of which is connected an applicator head. As an example, mascara applicators such as twisted wire mascara brushes known in the art comprise of an applicator head in which a plurality of bristles are held together between a wire portion that is bent in shape of a hairpin by twisting the wire portion. Recently a number of brushes are being produced by injection molding process. Injection molded brushes are made of a base body from which stick out a number of bristles. The density of bristles in these brushes is fixed and therefore, a metered or fixed amount of product such as mascara remains between the bristles of the cosmetic applicator for application. This, however may not be desirable by the user as the user might wish to apply different amounts of product at different times as per the convenience and wish of the user. For example, for application of product such as mascara, the length, thickness, density and shape of eyelashes will vary considerably for every user and therefore, the amount of product required for application. Further, it may be desirable to apply different amounts of mascara on the upper and lower eyelashes, or apply different quantities for two different looks. For such kind of applications users generally need to carry and use separate applicators which have different bristle densities for providing desired effect.

There are also present applicators wherein the bristle density is varied in a single applicator thereby providing a zoned mascara brush, however, again the densities are fixed on the applicator. Examples include WO 1995/17837 to The Procter & Gamble Company which discloses a mascara brush separated into a bulk deposition section and a lash separation section and similarly WO 96/031143 to E-L Management Corp. also discloses zoned mascara brushes. These zoned brushes provide product deposition and lash separation properties in an applicator however, the area of the brush to be used by the user is limited for carrying out the steps of application and separation. Moreover, they are not able to provide the user with an option of getting two different bristle densities in the same brush at two different times for desired effect/application.

Over the years certain cosmetic applicators having adjustable features allowing for versatility in applying greater or lesser amount of product such as mascara have been developed. U.S. Pat. No. 5,086,793 to Kingsford describes an adjustable mascara applicator in which the spacing between adjacent teeth of a comb can be varied for holding different amounts of mascara. The adjustable mascara applicator is formed by two adjacent comb sections, at least one of which is slidable relative to the other. However, in this case as the applicator is in the form of a comb, the user can only use it for lash separation and if used for product transfer then application of the product such as mascara to the eyelashes is inefficient. Moreover, wiping of excess product such as mascara from the teeth of the comb during the withdrawal thereof from the container storing the product is inefficient.

Therefore it becomes apparent from the above discussion that there exists a need for an applicator that is capable of retaining user-defined variable quantities of the product for application. Moreover, there is a need to provide an adjustable cosmetic applicator having teeth/bristles that extend circumferentially around the applicator head so as to provide efficient application of the product. There also exists a need for an applicator assembly that allows a user to adjust the spacing between the bristles of the applicator for application as per his/her requirements.

SUMMARY

The present invention generally is an adjustable applicator assembly and in particular, is an adjustable applicator assembly capable of being adjusted to retain variable quantities of a product on its bristles.

The terms 'adjustable applicator assembly' and 'applicator assembly' are herein used interchangeably referring to the applicator assembly that has an adjustable feature for varying the bristle density.

The invention also relates to containers comprising said adjustable applicator assembly for storing and application of consumer products such as cosmetic, hair care or dental products. The adjustable applicator assembly of the present invention is configured to comprise at least two applicator heads, wherein the applicator heads are arranged to be movable relative to each other thereby resulting in change in density of the bristles of the applicator assembly.

According to an embodiment of the invention there is provided an adjustable applicator assembly in which the applicator head has bristles extending around its circumference and is capable of varying the density of bristles as desired. Further, there is provided an applicator that allows a user to adjust the spacing between the bristles of the applicator for application as per his/her requirements. Also provided is an applicator assembly that gives the user an option of getting different kinds of applications from a single adjustable applicator.

According to an embodiment of the invention the adjustable applicator assembly comprises of a gripping member, a stem and at least two applicator heads. The stem has a proximal and a distal end. The proximal end of the stem is connected to the gripping member while the applicator heads are connected to the distal end of the stem. The at least two applicator heads are arranged to be movable relative to each other such that their relative displacement results in variation in the density of bristles of the adjustable applicator assembly.

In accordance with yet another embodiment of the invention each of the applicator heads comprise of a base body on which are present a plurality of bristles extending from its circumference. The bristles may extend out in parallel longitudinal rows on each of the applicator heads. Alternatively the bristles may extend in radially parallel rows or in any other suitable arrangement. The at least one applicator head may be arranged to be movable relative to each of the other applicator heads in a longitudinal direction. Alternatively the applicator heads may be arranged to be movable radially with respect to each other. The applicator heads may be suitably connected with each other to expose the rows of bristles of each of the applicator heads in a suitable arrangement.

According to yet another embodiment of the invention the applicator heads may be so arranged to expose the bristles of each of the applicator head in an alternate fashion, i.e. one row of bristles of one applicator head gets placed adjacent to one row of bristles of another applicator head. As an exemplary embodiment, one of the applicator heads may be placed concentrically inside the hollow of the other applicator head thereby exposing the bristle rows of each of the applicator heads. Alternatively the arrangement may be made to expose the rows of bristles of each of the applicator heads in a random fashion for example two rows of bristles of one applicator head may be arranged to be adjacent to one row of another applicator head or any other suitable arrangement.

According to yet another embodiment of the invention the adjustable applicator assembly further comprises of an adjustment means for moving at least one applicator head relative to other applicator heads thereby varying the spacing between the bristles of the applicator heads of the applicator assembly. Further, the stem of the applicator assembly has a cavity wherein said cavity houses a rod wherein said rod is connected to the adjustment means. Further, at least one of the applicator heads is connected to the rod in the stem such that the movement of the rod results in displacement of the at least one applicator head. One of the applicator heads may be made to be fixed to the distal end of the stem and the other applicator head kept to be movable in relation to the fixed one. Alternatively each of the applicator heads is connected to the stem in a movable manner and the applicator heads are arranged to be movable with respect to each other.

In accordance with yet another embodiment of the invention the adjustment means comprises of an actuator wherein said actuator may be a dialer, a slider, a button or any suitable actuating means. The adjustment means optionally comprises a motion converter. The motion converter is connected to the actuator and the rod in the cavity of the stem wherein the actuator when actuated causes the motion converter to convert a rotational movement of the actuator into a translational movement of the stem and thereby displacing the at least one of the applicator heads. The motion converter may function mechanically, electrically, magnetically or by any other suitable mechanisms. Further, the displacement of the applicator heads may be so adjusted by way of adjustment means that varying densities of bristles in the applicator are achieved. The adjustment means may be connected to the gripping member of the applicator assembly for adjusting the bristle density. Alternatively, the adjustment means may be suitably placed in the applicator assembly to cause the adjustment of variation in bristle density of the applicator assembly.

According to yet another embodiment of the invention the adjustable applicator assembly comprises of a gripping member, a stem and two applicator heads. The stem has a proximal and a distal end. The proximal end of the stem is connected to the gripping member while one of the two applicator heads are connected to the distal end of the stem. The two applicator heads are arranged to be movable relative to each other such that their relative movement results in variation in the density of bristles of the adjustable applicator assembly. Each of the applicator heads comprises of a base body on which are present a plurality of bristles extending from its circumference. The bristles extend out in parallel longitudinal rows on each of the applicator heads. Alternatively the bristles may extend radially parallel or in any other suitable arrangement. At least one applicator head may be arranged to be movable relative to the other applicator heads in a longitudinal direction. Alternatively the applicator heads may be arranged to be movable radially with respect to each other. The applicator heads may be suitably connected with each other to expose the rows of bristles of each of the applicator heads in a suitable arrangement. Further, the applicator heads may be so arranged to expose the bristles of each of the applicator head in an alternate fashion, i.e. one row of bristles of one applicator head gets placed adjacent to one row of bristles of another applicator head. Alternatively the arrangement may be made to expose the rows of bristles of each of the applicator heads in a random fashion for example two rows of bristles of one applicator head may be arranged to be adjacent to one row of another applicator head or any other suitable arrangement. The adjustable applicator assembly further comprises of an adjustment means for moving at least one applicator head relative to other applicator heads thereby varying the spacing between the bristles of the applicator heads of the adjustable applicator assembly. The stem of the adjustable applicator assembly has a cavity wherein said cavity houses a rod which in turn is connected to the adjustment means. Further, at least one of the applicator heads is connected to the rod in the stem such that the movement of the rod results in displacement of the applicator head. One of the applicator heads may be made to be fixed to the distal end of the stem and the other applicator head is kept to be movable in relation to the fixed one. Alternatively both of the applicator heads are connected to the stem in a movable manner and are arranged to be movable with respect to each other. The adjustment means comprises of an actuator wherein said actuator may be a dialer, a slider, a button or any suitable actuating means. The adjustment means optionally comprises a motion converter. The motion converter is connected to the actuator and the rod in the cavity of the stem wherein the actuator when actuated causes the motion converter to convert a rotational movement of the actuator into a translational movement of the stem and thereby displacing the at least one of the applicator heads. The motion converter may function mechanically, electrically, magnetically or by any other suitable mechanisms. Further, the displacement of the applicator heads may be so adjusted by way of adjustment means that varying densities of bristles in the applicator are achieved. The adjustment means may be connected to the gripping member of the applicator assembly for adjusting the bristle density. Alternatively, the adjustment means may be suitably placed in the applicator assembly to cause the adjustment of variation in bristle density of the applicator assembly.

According to yet another embodiment of the present invention there is provided a container comprising a receptacle for storing the product and an adjustable applicator assembly for applying the product. The receptacle has an open end and a closed end thereby forming a cavity for storage of product. Further, there may be present a wiper assembly for wiping off the excess product from the applicator assembly when being withdrawn form the container for application. The adjustable applicator assembly comprises of a gripping member, a stem and at least two applicator heads. The open end of the receptacle may define a neck for being closed by the gripping member of the applicator assembly. The stem has a proximal and a distal end. The proximal end of the stem is connected to the gripping member while the applicator heads are connected to the distal end of the stem. The at least two applicator heads are arranged to be movable relative to each other such that their relative movement results in variation in the density of bristles of the adjustable applicator assembly. Each of the applicator heads comprise of a base body on which are present a plurality of bristles extending from its circumference. The bristles extend out in parallel longitudinal rows on each of the applicator heads. Alternatively the bristles may extend radially parallel or in any other suitable arrangement. The at least one applicator head may be arranged to be movable relative to each of the other applicator heads in a longitudinal direction. Alternatively the applicator heads may be arranged to be movable radially with respect to each other. The applicator heads may be suitably connected with each other to expose the rows of bristles of each of the applicator heads in a suitable arrangement. The applicator heads of the adjustable applicator assembly of the container may be so arranged to expose the bristles of each of the applicator head in an alternate fashion, i.e. one row of bristles of one applicator head gets placed adjacent to one row of bristles of another applicator head. Alternatively the arrangement may be made to expose the rows of bristles of each of the applicator heads in a random fashion for example two rows of bristles of one applicator head may be arranged to be adjacent to one row of another applicator head or any other suitable arrangement.

In accordance with yet another embodiment of the invention the container further comprises of an adjustment means for moving at least one applicator head relative to other applicator heads thereby varying the spacing between the bristles of the applicator heads of the adjustable applicator assembly. Further, the stem of the adjustable applicator assembly has a cavity wherein said cavity houses a rod which in turn is connected to the adjustment means. Further, at least one of the applicator heads is connected to the rod in the stem such that the movement of the rod results in displacement of the applicator head. One of the applicator heads may be made to be fixed to the distal end of the stem and the other applicator head is kept to be movable in relation to the fixed one. Alternatively each of the applicator heads is connected to the stem in a movable manner and all applicator heads are arranged to be movable with respect to each other. The adjustment means comprises of an actuator wherein said actuator may be a dialer, a slider, a button or any suitable actuating means. The adjustment means optionally comprises a motion converter. The motion converter is connected to the actuator and the rod in the cavity of the stem wherein the actuator when actuated causes the motion converter to convert a rotational movement of the actuator into a translational movement of the stem and thereby displacing the at least one of the applicator heads. The motion converter may function mechanically, electrically, magnetically or by any other suitable mechanisms. Further, the displacement of the applicator heads may be so adjusted by way of adjustment means that varying densities of bristles in the applicator are achieved.

The adjustable applicator assembly according to the present invention therefore provides for user-defined varying of spacing between the bristles of the applicator head to get the sparse or denser application of the product by the user.

According to another embodiment of the invention, the adjustable applicator assembly of the present invention may be used for application of a cosmetic, hair care product or dental product such as a mascara, hair color, etc.

These and further aspects which will be apparent to the expert of the art are attained by an adjustable applicator assembly in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
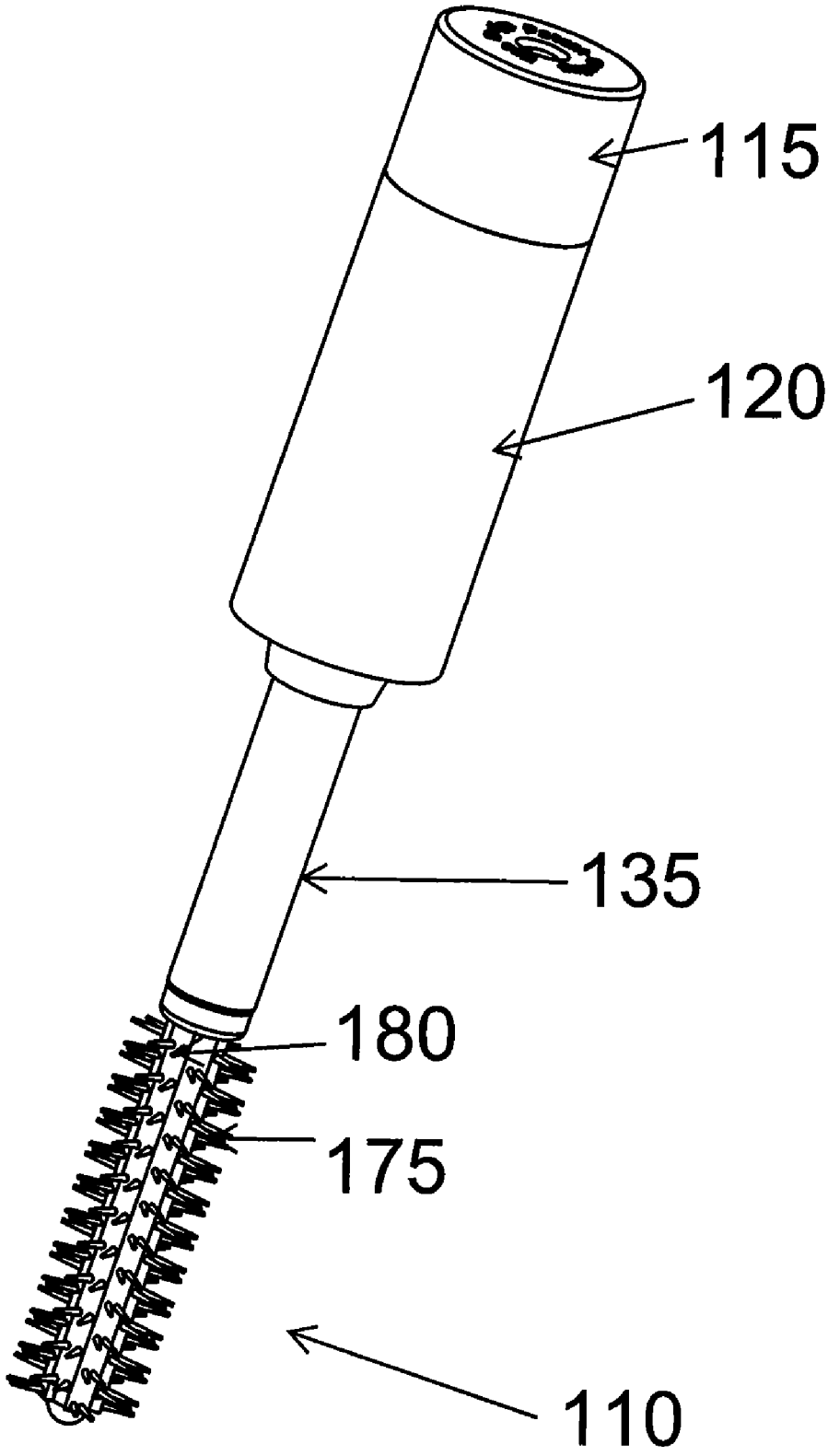
FIG. 1 illustrates an isometric view of the adjustable applicator assembly according to one embodiment of the invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

FIG. 1 is one embodiment of the present invention showing an isometric view of the adjustable applicator assembly 110. The adjustable applicator assembly 110 comprises of a gripping member 120, an adjustment means 115, a stem 135 and two applicator heads 175 and 180 respectively. The adjustable applicator assembly 110 as shown comprises of two applicator heads; however, an embodiment where the adjustable applicator assembly 110 comprises more than two applicator heads is also contemplated. The adjustment means 115 causes the displacement of at least one applicator head relative to other applicator heads thereby varying the spacing between the bristles of the applicator heads of the adjustable applicator assembly 110. The adjustment means 115 as shown in the figure comprises of an actuator 115*a* wherein said actuator 115*a* is a dialer however, the actuator 115*a* may be a slider, a button or any other suitable actuating means. The actuator 115*a* is connected to the gripping member 120 by a suitable fastening means such as a snap-fit, however, any lock and key arrangement between the actuator 115*a* and gripping member 120 may be used. Alternatively, the adjustment means 115 may be placed at any other suitable position in the applicator assembly to cause variation in the density of the bristles.

Figure 2:
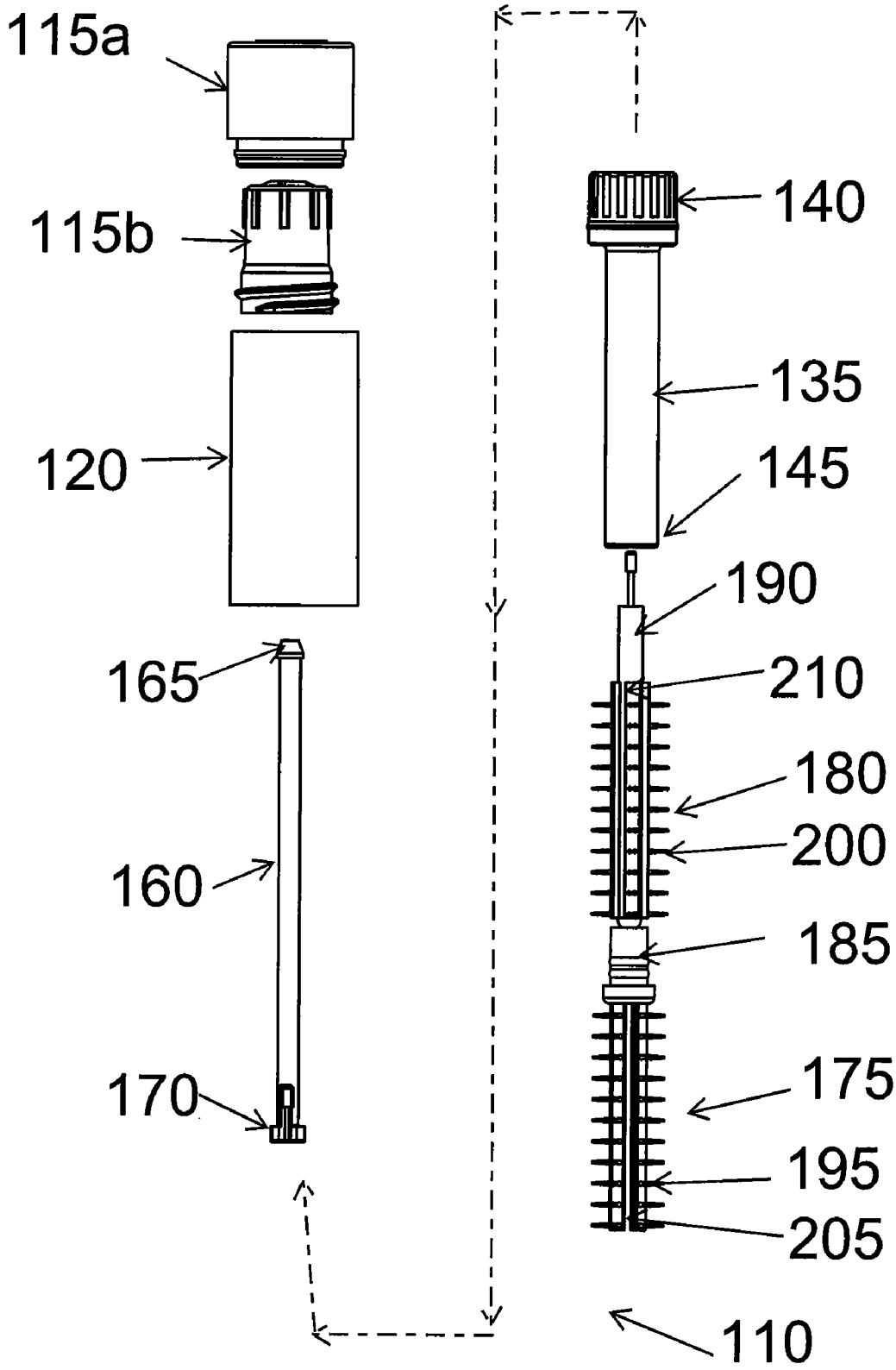
FIG. 2 illustrates an exploded view of the adjustable applicator assembly of FIG. 1.
Figure 3:
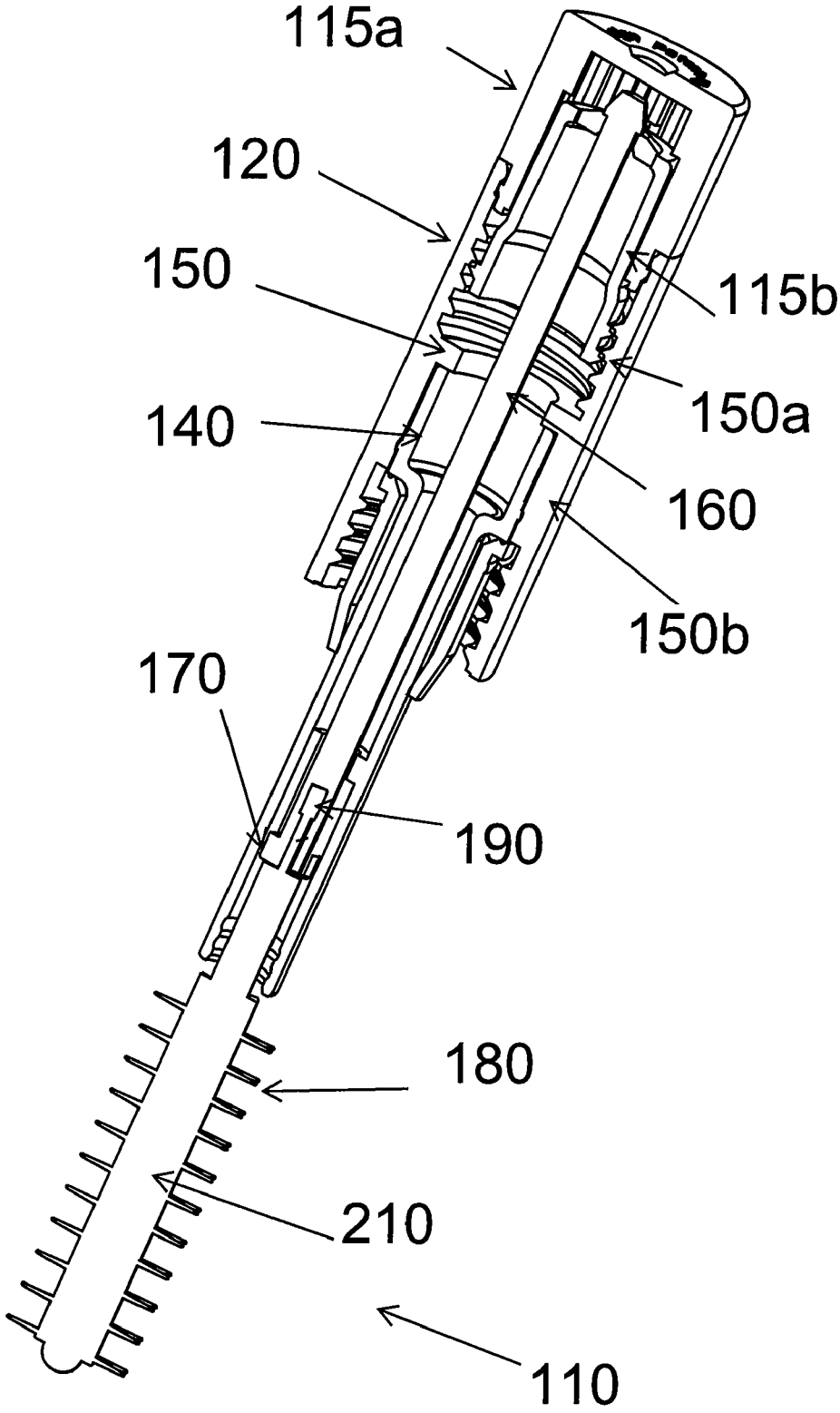
FIG. 3 illustrates a cross sectional view of the adjustable applicator assembly of FIG. 1 showing the arrangement of an applicator head according to one embodiment of the present invention.
Figure 4:
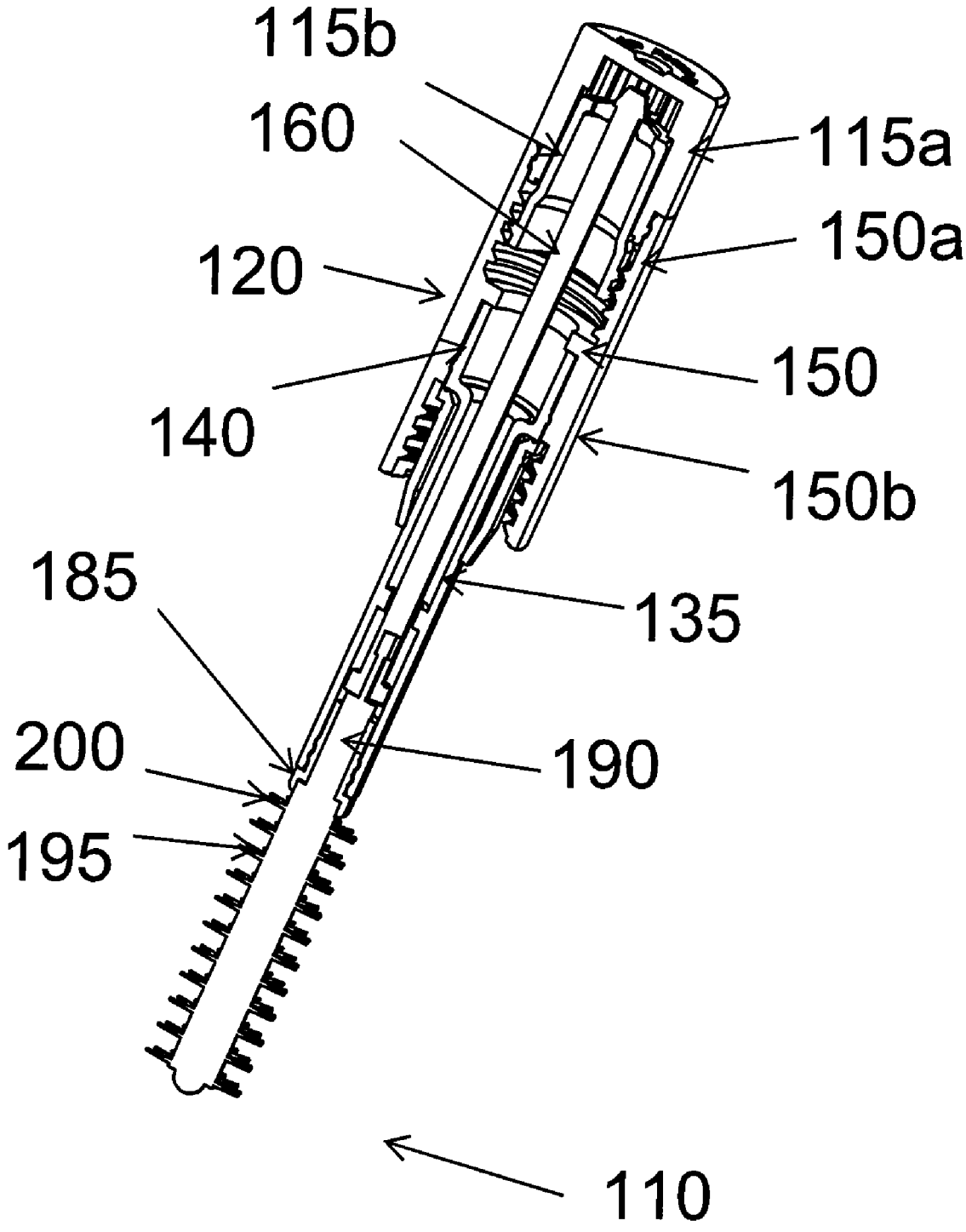
FIG. 4 illustrates a cross sectional view of the adjustable applicator assembly of FIG. 1 showing the arrangement of the two applicator heads.

As represented by FIGS. 2 to 4, the adjustment means 115 further comprises of a motion converter 115*b* which is connected to the actuator 115*a* by a threaded screw arrangement, however, any suitable lock and key arrangement may be used. The inner portion of the gripping member 120 is divided into two sections 150*a* and 150*b* respectively by a ledge 150 wherein the upper portion 150*a* houses the motion converter 115*b* whereas the lower portion 150*b* houses the proximal end 140 of the stem 135. Further, the stem 135 has a cavity which houses a rod 160. The rod 160 has a proximal end 165 and a distal end 170. The rod 160 passes through the motion converter 115*b* and its proximal end 165 is fixed at the top end of the motion converter 115*b*. The distal end 170 of the rod 160 is connected to one of the applicator heads 180. The stem 135 has a proximal end 140 and a distal end 145. The applicator head 180 has a proximal end 190 which is connected with the distal end 170 of the rod 160. Further, the proximal end 185 of the applicator head 175 is connected to the distal end 145 of the stem 135. Each of the applicator heads 175 and 180 comprises of a base body 205, 210 respectively on which are present a plurality of bristles 195 and 200 respectively.

As represented in FIGS. 2 to 4, each of the applicator heads 175 and 180 comprises of a base body 205, 210 respectively on which are present a plurality of bristles 195 and 200 respectively. The plurality of bristles 195 and 200 extend out from the circumference of the base body 205 and 210 of the applicator heads 175 and 180 respectively. As shown in figures, the plurality of bristles 195 and 200 extend out in parallel longitudinal rows on each of the applicator heads 175 and 180 respectively. Alternatively the bristles may extend radially parallelly or in any other suitable arrangement.

As represented by figures, at least one applicator head is 180 arranged to be movable relative to the other applicator head 175 in a longitudinal direction. However, alternatively the applicator heads may be arranged to be movable radially with respect to each other. Further, the applicator heads may be suitably connected with each other to expose the rows of bristles of each of the applicator heads in a suitable arrangement. As shown, the applicator heads 175 and 180 are so arranged to expose the bristles of each of the applicator head in an alternate fashion, i.e. one row of bristles of the applicator head 175 gets placed adjacent to one row of bristles of the applicator head 180. However, alternatively the arrangement may be made to expose the rows of bristles of each of the applicator heads in a random fashion for example two rows of bristles of the applicator head 175 may be arranged to be adjacent to one row of the applicator head 180 or any other suitable arrangement.

FIG. 3 shows a cross sectional view of the adjustable applicator assembly 110 showing the arrangement of one applicator head 180 with the rod 160 inside the cavity of the stem 135 according to an embodiment of the present invention. As embodied herein and shown in the figure, the proximal end 190 of the applicator head 180 is connected to the distal end 170 of the rod 160 by a suitable fastening means.

FIG. 4 illustrates a cross sectional view of the adjustable applicator assembly 110 showing the arrangement of the applicator head 175 and the applicator head 180 according to an embodiment of the present invention. As embodied herein and shown in the figure, the proximal end 185 of the applicator head 175 is suitably fastened to the distal end 145 of the stem 135 and the applicator head 180 is connected to the distal end 170 of the rod 160.

Figures 5A, 5B:
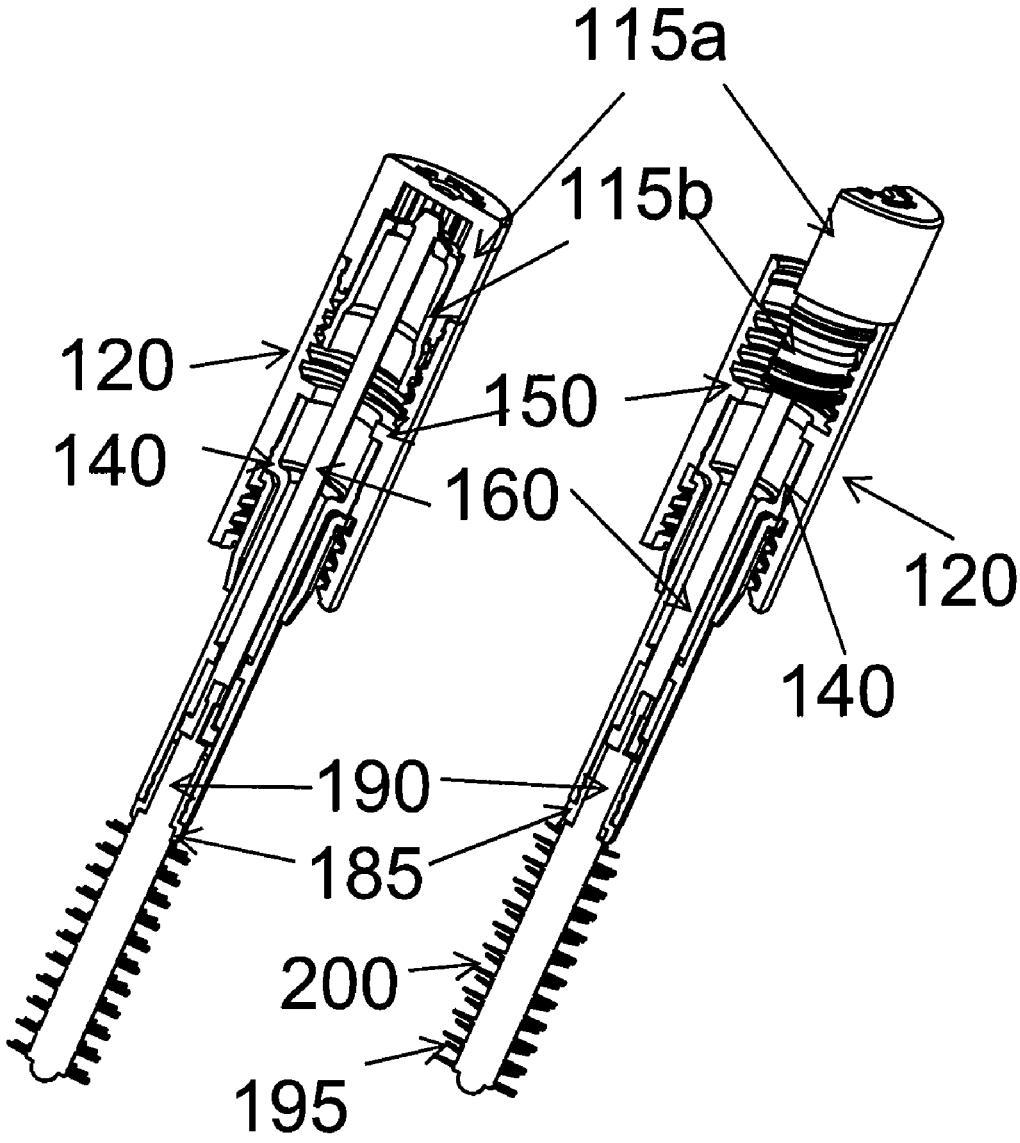
FIG. 5*a* and FIG. 5*b* illustrate the cross sectional views of the adjustable applicator assembly of FIG. 1 showing the reduced and increased spacing between the bristles of a first applicator head and a second applicator head according to one embodiment of the present invention.

FIG. 5*a* and FIG. 5*b* illustrate a cross sectional view of the adjustable applicator assembly 110 with a reduced spacing and maximum spacing between the bristles 195, 200 of the applicator heads 175 and 180 respectively according to one embodiment of the present invention. As embodied herein and shown in the FIG. 5*a*, each row of the bristles 195, 200 of the applicator heads 175 and 180 are aligned along the common axis when the adjustment means 115 is in its initial position, i.e. not actuated. The actuator 115*a* when rotated causes the motion converter 115*b* to convert a rotational movement of the actuator 115*a* into a translational movement of the stem 135 and thereby displacing the at least one of the applicator heads 180. Further, the displacement of the applicator heads 180 may be so adjusted by way of adjustment means 115 that varying densities of bristles in the adjustable applicator assembly 110 are achieved. As seen in FIG. 5*a*, the actuator is in its initial position and the bristles of the applicator heads of the assembly 110 are placed apart. Such an arrangement of bristles gives a density of bristles which may be used for thicker application of the product such as mascara to the eyelashes.

As shown in the FIG. 5*b*, when the actuator 115*a* of the adjustment means 115 is actuated, i.e. the dialer 115*a* is rotated in an anti clock wise direction, the motion converter 115*b* also moves along with the actuator 115*a* as shown and thereby results in the upward movement of the rod 160 in the longitudinal direction. However, the actuator may be actuated in any suitable manner to cause displacement of the rod and thereby cause variation in density. The movement of rod 160 in the longitudinal direction results in the displacement of the applicator head 180 in the longitudinal direction, and thereby results in positioning the bristles the applicator head 175 and the applicator head 180 very closely with a minimum space in between them. The decreased spacing between the bristles of the applicator head 175 and the applicator head 180 allows an accurate application of the product such as mascara to the eyelashes. The application in this state of the applicator head gives a better separation of lashes in case of mascara and there occurs very less clumping. The actuator 115*a* when rotated in the clockwise direction brings the applicator head 180 to its initial position.

Figure 6:
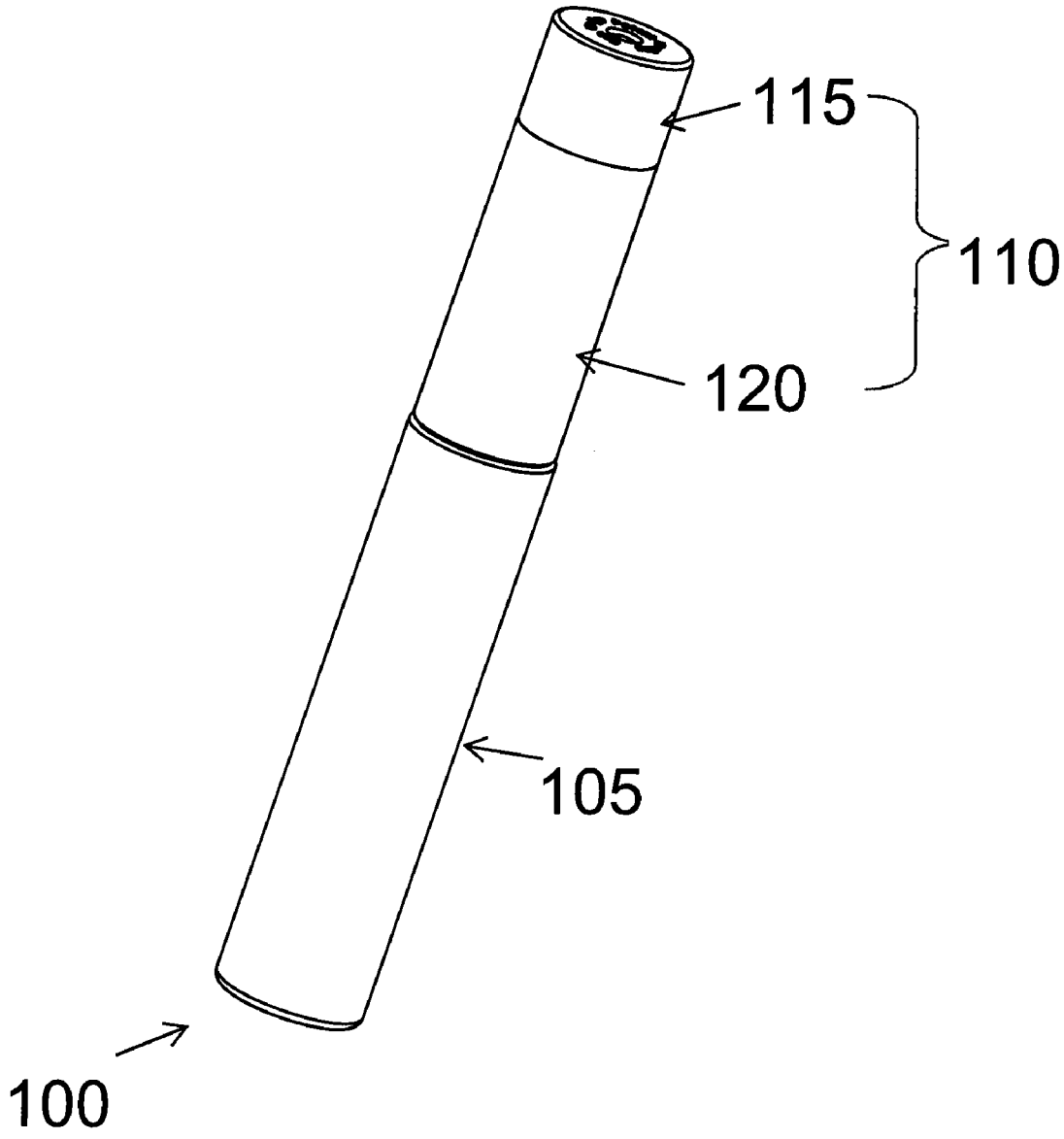
FIG. 6 illustrates an isometric view of a container in closed position comprising the adjustable applicator assembly according to one embodiment of the present invention.

FIG. 6 illustrates an isometric view of a container 100 in closed position with respect to one embodiment of the present invention. As embodied herein and shown in figure, the container 100 comprises a receptacle 105 and the adjustable applicator assembly 110 as described above. As shown in figure, the receptacle 105 is of cylindrical cross section extending in the longitudinal direction, however, the receptacle 105 can take any suitable shape. As shown in FIGS. 6 through to 8, the receptacle 105 is closed by the gripping member 120 by way of a threaded screw arrangement however, any other suitable lock and key arrangement may be used to close the receptacle 105. The adjustment means 115, the gripping member 120 and the receptacle 105 are of substantially same cross section so as to align along a common axis when fastened to each other in the closed position of the container 100.

Figure 7:
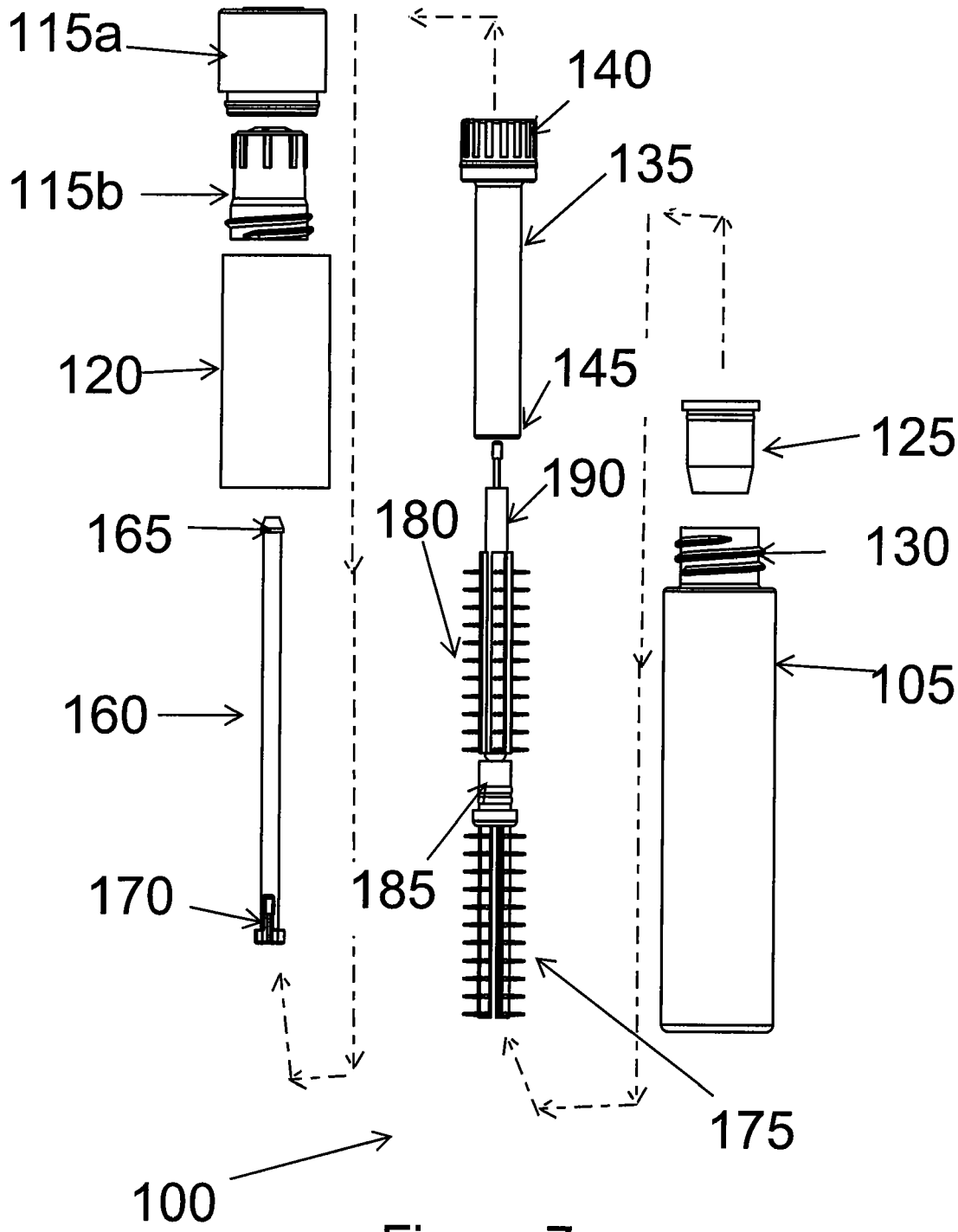
FIG. 7 illustrates an exploded view of the container shown in FIG. 5.
Figure 8:
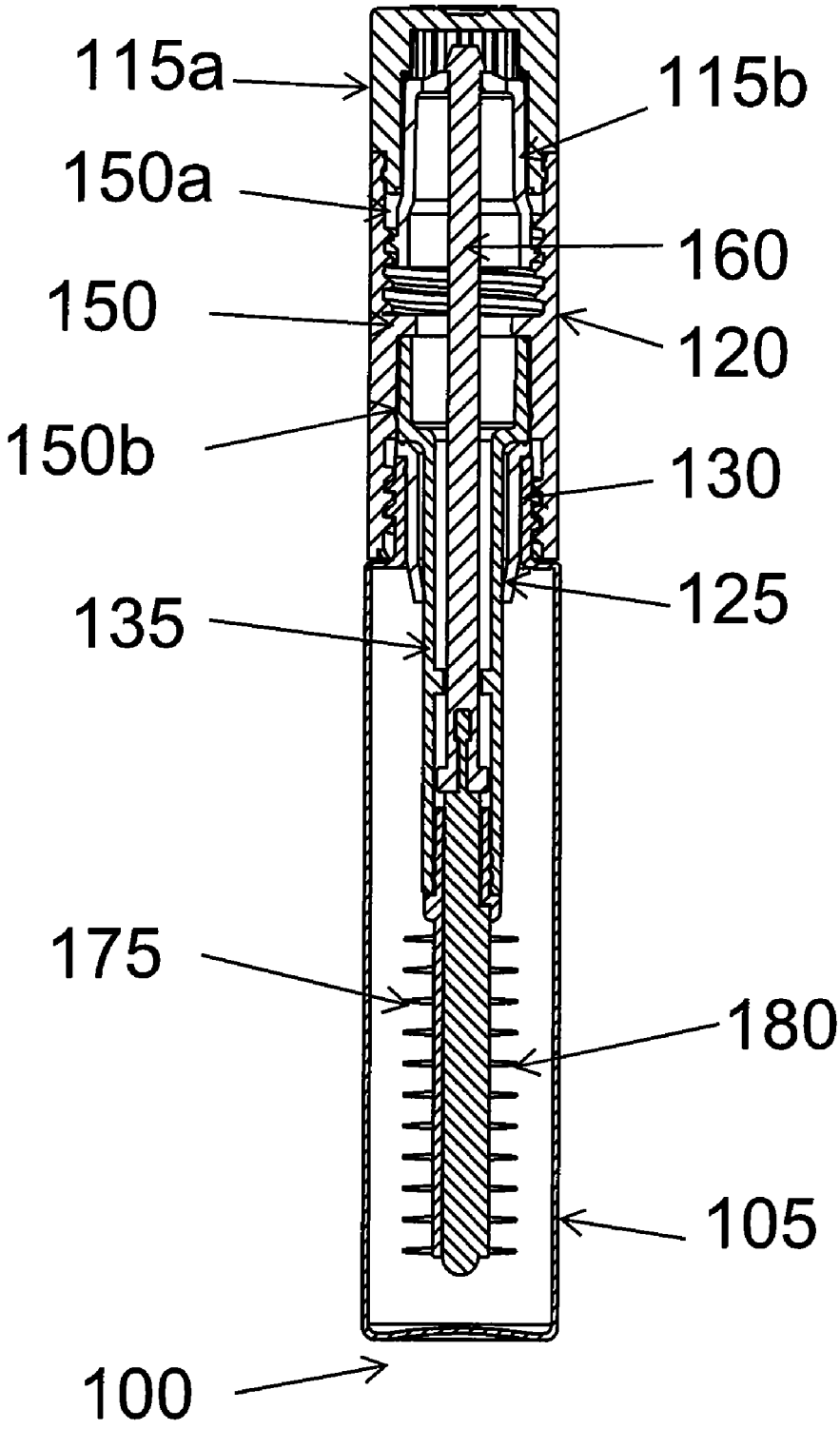
FIG. 8 illustrates a cross sectional view of the container shown in FIG. 6.

As shown in FIGS. 6 to 8, the receptacle 105 has a closed end and an open end in the form of a neck 130 thereby defining a cavity for holding a product. The receptacle 105 may further include a wiper 125, which may be one time snap fitted to the neck 130 of the receptacle 105, however, the wiper 125 may be fitted onto the neck 130 of the receptacle 105 by any other suitable arrangement.

A user may utilize the container 100 as described in above embodiments for application of a product. Moreover, the adjustable applicator assembly 110 of the container 100 allows the user to vary the density the bristles of the applicator heads thereby making the bristle density either sparse or denser.

The materials suitable for forming the receptacle 105 and the rod 160 may be polyprolpylene or any other suitable polymeric material while the gripping member 120, adjustment means 115 and the motion converter 115*b* may be formed of acrylonitrile butadiene styrene or any other suitable material. The applicator heads 175 and 180 may be made of any suitable polymeric material. The stem 135 may be formed of polyacetal. The material for forming wiper 125 could be low-density polyethylene. The aforementioned materials for forming various parts of the container of the present invention are an example, however other suitable materials may also be used. Depending upon the substance being used in the receptacle, a variety of sizes and shapes of the applicator heads can be utilized. It could have a shape other than cylindrical such as ovular, tapered or any other suitable shape.

Although the above description and drawings show the container being cylindrical, the shapes and profile cross section thereof are not limited to the same.

While the foregoing is directed to embodiments of the present invention, other and further embodiments of the invention may be devised without departing from the basic scope thereof, and the scope thereof is determined by the claims that follow. Accordingly, the appended claims should be construed to encompass not only those forms and embodiments of the invention specifically described above, but to such other forms and embodiments as may be devised by those skilled in the art without departing from its true spirit and scope.

What is claimed is:

1. An applicator assembly comprising of i. a gripping member, ii. a stem, said stem having a proximal and a distal end; and iii. at least two applicator heads, wherein each of said applicator heads comprising of a base body on which are present a plurality of bristles extending from the circumference of the base body, and the base body of at least one applicator head having a hollow interior, and wherein at least one of said applicator heads is placed concentrically inside the hollow interior of said other applicator head to expose the bristle rows of each of the applicator heads;

wherein the proximal end of the stem is connected to the gripping member and the applicator heads are connected to the distal end of the stem characterized in that the at least two applicator heads are arranged to be movable relative to each other wherein the relative movement of the applicator heads results in variation in the density of bristles of the applicator assembly.

2. The applicator assembly according to claim 1 wherein the bristles on each of the applicator heads extend out in parallel longitudinal rows.

3. The applicator assembly according to claim 1 wherein the bristles on each of the applicator heads extend radially parallel rows on the base body.

4. The applicator assembly according to claim 1 wherein the at least one applicator head is arranged to be movable relative to each of the other applicator heads in a longitudinal direction.

5. The applicator assembly according to claim 1 wherein the at least one applicator head is arranged to be movable radially with respect to each of the other applicator heads.

6. The applicator assembly according to claim 1 wherein the applicator heads are connected with each other to expose the rows of bristles of each of the applicator heads in a predetermined arrangement.

7. The applicator assembly according to claim 1 further comprising an adjustment means for moving at least one applicator head relative to other applicator heads thereby varying the spacing between the bristles of the applicator heads of the applicator assembly.

8. The applicator assembly according to claim 7 wherein the adjustment means comprises of an actuator wherein said actuator is a dialer, a slider, a button or any suitable actuating means.

9. The applicator assembly according to claim 8 wherein the stem of the applicator assembly has a cavity wherein said cavity in said stem houses a rod, said rod being connected to the adjustment means.

10. The applicator assembly according to claim 9 wherein at least one of the applicator heads is connected to the rod in the stem such that the movement of the rod results in displacement of the said applicator head.

11. The applicator assembly according to claim 10 wherein the applicator heads are connected to the rod and each of the applicator head is movable with respect to the other applicator head.

12. The applicator assembly according to claim 11 wherein the at least one of the applicator heads is fixed to the distal end of the stem and the other applicator heads are movable in relation to the at least one fixed applicator head.

13. The applicator assembly according to claim 12 wherein the adjustment means, when actuated, causes the displacement of each of the applicator heads with respect to the other applicator heads.

14. The applicator assembly according to claim 13 wherein the adjustment means comprises a motion converter.

15. The applicator assembly according to claim 14 wherein said motion converter operates either mechanically, electrically or magnetically.

16. The applicator assembly according to claim 15 wherein the motion converter is connected to the actuator of the adjustment means and the rod in the cavity of the stem.

17. The applicator assembly according to claim 16 wherein the actuator when actuated causes the motion converter to convert a movement of the actuator into a translational movement of the rod and thereby displacing the at least one of the applicator heads.

18. The applicator assembly according to claim 17 wherein the displacement of the applicator heads by way of the adjustment means results in variation of the densities of bristles in the applicator head arrangement.

19. The applicator assembly according to claim 18 wherein the applicator assembly comprises two applicator heads.

20. The applicator assembly according to claim 19 wherein the proximal end of the stem is connected to the gripping member and the two applicator heads are connected to the distal end of the stem.

21. The applicator assembly according to claim 20 wherein the two applicator heads are arranged to be movable relative to each other such that their relative movement results in variation in the density of bristles of the applicator assembly.

22. A container comprising i. a receptacle for storing a product; and ii. an applicator assembly as claimed in claim 1 for applying the product.

23. An applicator assembly comprising of i. a gripping member, ii. a stem, said stem having a proximal and a distal end; and iii. at least two applicator heads, wherein each of said applicator heads comprising of a base body on which are present a plurality of bristles extending from the circumference of the base body, the base body of at least one of the applicator heads having a hollow interior, and wherein at least one of said applicator heads is placed concentrically inside the hollow interior of said other applicator head to expose the bristle rows of each of the applicator heads;

wherein the proximal end of the stem is connected to the gripping member and the applicator heads are connected to the distal end of the stem characterized in that the at least two applicator heads are arranged to be movable relative to each other wherein the relative movement of the applicator heads results in variation in the density of bristles of the applicator assembly;

wherein the bristles on each of the applicator heads extend out in parallel longitudinal rows;

wherein optionally the bristles on each of the applicator heads extend radially parallel rows on the base body;

wherein the at least one applicator head is arranged to be movable relative to each of the other applicator heads in a longitudinal direction;

wherein optionally the at least one applicator head is arranged to be movable radially with respect to each of the other applicator heads;

wherein the applicator heads are connected with each other to expose the rows of bristles of each of the applicator heads in a predetermined arrangement;

wherein said applicator assembly further comprises an adjustment means for moving at least one applicator head relative to other applicator heads thereby varying the spacing between the bristles of the applicator heads of the applicator assembly;

wherein the adjustment means comprises of an actuator wherein said actuator is a dialer, a slider, a button or any suitable actuating means;

wherein the stem of the applicator assembly has a cavity wherein said cavity in said stem houses a rod, said rod being connected to the adjustment means;

wherein at least one of the applicator heads is connected to the rod in the stem such that the movement of the rod results in displacement of the said applicator head;

wherein the applicator heads are connected to the rod and each of the applicator heads is movable with respect to the other applicator head;

wherein the at least one of the applicator heads is optionally fixed to the distal end of the stem and the other applicator heads are kept to be movable in relation to the fixed one;

wherein the actuator of the adjustment means when actuated causes the displacement of each of the applicator heads with respect to the other applicator heads;

wherein the adjustment means optionally comprises a motion converter; wherein said motion converter operates either mechanically, electrically or magnetically;

wherein the motion converter is connected to the actuator of the adjustment means and the rod in the cavity of the stem;

wherein the actuator when actuated causes the motion converter to convert a movement of the actuator into a translational movement of the rod and thereby displacing the at least one of the applicator heads;

wherein the displacement of the applicator heads by way of the adjustment means results in variation of the densities of bristles in the applicator head arrangement; and wherein the applicator assembly optionally comprises a receptacle for storing a product.

* * * * *